US006997203B2

(12) United States Patent
Tsigonis

(10) Patent No.: US 6,997,203 B2
(45) Date of Patent: Feb. 14, 2006

(54) SYSTEM AND METHOD FOR DISTRIBUTING LIQUID FLOW INTO PREDETERMINED PROPORTIONS

(76) Inventor: Robert C. Tsigonis, P.O. Box 10750, Fairbanks, AK (US) 99710-0750

( * ) Notice: Subject to any disclaimer, the term of this patent is extended or adjusted under 35 U.S.C. 154(b) by 250 days.

(21) Appl. No.: 10/341,776

(22) Filed: Jan. 14, 2003

(65) Prior Publication Data

US 2004/0134542 A1 Jul. 15, 2004

(51) Int. Cl.
*E03B 11/00* (2006.01)

(52) U.S. Cl. ..... 137/14; 137/561 A; 137/577; 137/588; 137/44; 137/45

(58) Field of Classification Search ..... 137/577, 137/588, 561 A, 14, 44, 45, 40
See application file for complete search history.

(56) References Cited

U.S. PATENT DOCUMENTS

| | | | | |
|---|---|---|---|---|
| 3,497,067 A | | 2/1970 | Tyson | |
| 3,956,137 A | | 5/1976 | Dempsey | |
| 4,015,629 A | * | 4/1977 | Morgan et al. | 137/578 |
| 4,298,470 A | | 11/1981 | Stallings | |
| 4,505,297 A | * | 3/1985 | Leech et al. | 137/561 A |
| 4,605,501 A | | 8/1986 | Tyson | |
| 4,838,731 A | | 6/1989 | Gavin | |
| 5,098,568 A | | 3/1992 | Tyson | |
| 5,107,892 A | * | 4/1992 | Plachy | 137/561 A |
| 5,154,353 A | | 10/1992 | Plachy | |
| 5,241,867 A | * | 9/1993 | Cohen et al. | 73/863.41 |
| 5,322,387 A | | 6/1994 | Heine et al. | |
| 5,538,035 A | | 7/1996 | Gavin | |
| 5,655,564 A | | 8/1997 | Gavin | |
| 5,680,989 A | | 10/1997 | Plachy et al. | |
| 5,988,943 A | | 11/1999 | McCord | |
| 6,012,871 A | | 1/2000 | Bryant | |
| 6,112,766 A | | 9/2000 | Zoeller et al. | |
| 6,152,650 A | | 11/2000 | Heine | |
| 6,216,733 B1 | | 4/2001 | Sondov | |
| 6,474,361 B1 | | 11/2002 | Poppe | |
| 6,482,322 B1 | | 11/2002 | Tsigonis | |
| 6,503,392 B1 | | 1/2003 | Tyson | |

FOREIGN PATENT DOCUMENTS

| | | |
|---|---|---|
| FR | 2 774109 A | 7/1999 |
| WO | WO 03/096795 A | 11/2003 |

OTHER PUBLICATIONS

International Search Report, application No. PCT/No 03/00156, dated Aug. 20, 2003.

* cited by examiner

*Primary Examiner*—A. Michael Chambers
(74) *Attorney, Agent, or Firm*—RatnerPrestia

(57) ABSTRACT

A system configured to distribute liquid flow into predetermined proportions is provided. The system includes a distributor defining a plurality of distributor outlets configured to deliver liquid from the distributor. A receptacle is positioned to receive liquid, the receptacle defining a plurality of receptacle outlets oriented to deliver liquid portions toward the distributor outlets. The receptacle is pivotally mounted for movement with respect to the distributor, and is self-leveling such that liquid is divided by the receptacle outlets into predetermined proportions.

36 Claims, 16 Drawing Sheets

SYSTEM AND METHOD FOR DISTRIBUTING LIQUID FLOW INTO PREDETERMINED PROPORTIONS

FIELD OF THE INVENTION

This invention relates to a system for distributing liquid flow into predetermined proportions. More specifically, this invention provides a system having a distributor and a self-leveling receptacle to help ensure even distribution of liquids such as effluent.

BACKGROUND OF THE INVENTION

In various applications and industries, there is often a need to provide for dividing and distributing of liquids. For example, there is often a need to distribute waste liquid, including wastewater and effluent. In particular, systems are sought for dividing the flow of wastewater, effluent, or other liquid into two or more equal aliquots, or other proportions, for distribution to separate outlets. The divided flow is then transferred to, for example, other treatment processes or different leach lines in a leach field. In the field of sewage treatment, such a liquid distribution system for dividing the flow of wastewater, effluent, or other liquid into two or more equal aliquots is referred to as a distribution box or D-box.

Many wastewater and sewage disposal systems are designed to disperse wastewater and/or effluent discharged from a wastewater storage system or septic tank into an absorption field. For example, the effluent discharged from a septic tank is conventionally directed first into a standard effluent distribution box. The distribution box is intended to divide the flow of effluent into separate, reasonably equal quantities of effluent, which then pass through separate discharge pipes for distribution in the absorption field. This division of effluent prevents overloading in a single discharge pipe. Unequal discharge of effluent can result in disproportionately high effluent loading in one of the discharge pipes, which can saturate the soil in one location while other locations receive only minimal effluent.

Conventionally, distribution boxes have one singular sump, relying exclusively on the inherent characteristics of liquids to seek their own level and divide themselves into separate flows by means of a number of discharge pipes connected to the singular sump. Each discharge pipe directs an allocated portion of the effluent into different locations in the absorption field. Each of the discharge pipes in the distribution box are set at the same elevation to encourage distribution of equal quantities of effluent into each of the discharge pipes. If the discharge pipes are set at different elevations, effluent entering the distribution box tends to flow out of the discharge pipe that is located at the lowest elevation in the distribution box, even if the difference in elevation among the discharge pipes is minimal.

Even recognizing the need to maintain the discharge pipes located within the distribution box at the same elevation, it is often difficult to install the discharge pipes perfectly level within the ground. Furthermore, even if the discharge pipes are properly installed so that they are level within the ground, it is often difficult to maintain them in a level position because of settling of the ground and other naturally occurring events. For example, components such as septic tanks, distribution boxes, interconnecting pipes, and leach fields commonly shift shortly after installation due to the settling of backfill in their vicinity. Also, such components sometimes shift when the soil around them heaves or falls due to frost action or due to shrinking or swelling related to changes in moisture content. Foot or vehicular traffic, erosion, earthquakes, and other events can also cause components to shift and move out of level.

A number of distribution systems have been proposed over the years. However, when a distribution box shifts after installation and the outlet pipes are no longer at their intended elevations, conventional systems fail to adequately compensate.

Even those discharge systems previously proposed to solve the problem of equalizing the flow of effluent out of a distribution box require human intervention. In other words, such systems must be monitored, inspected, and adjusted by a person. Due to the potentially severe consequences of disproportionate effluent loading, such monitoring and inspection may be a frequent operation taking considerable time and effort. Accordingly, there remains a need for a liquid distribution system that minimizes or even eliminates the need for human intervention after installation to maintain the intended distribution of liquid.

SUMMARY OF THE INVENTION

According to one exemplary embodiment, the present invention provides a system configured to distribute liquid flow into predetermined proportions. The system includes a distributor defining a plurality of distributor outlets configured to deliver liquid from the distributor. A receptacle is positioned to receive liquid, the receptacle defining a plurality of receptacle outlets oriented to deliver liquid portions toward the distributor outlets. The receptacle is pivotally mounted for movement with respect to the distributor, and is self-leveling such that liquid is divided by the receptacle outlets into predetermined proportions.

Another exemplary embodiment of the present invention provides a method for configuring a liquid distributor to distribute liquid flow into predetermined proportions. The method includes positioning a receptacle to receive liquid and orienting outlets of the receptacle to deliver liquid toward outlets of the liquid distributor. The receptacle is pivotally mounted for movement and is self-leveling with respect to the liquid distributor such that liquid is divided by the receptacle outlets into the predetermined proportions.

A further exemplary embodiment of the present invention provides a method for distributing liquid flow into predetermined proportions. The method includes supplying liquid to a receptacle and delivering liquid from the receptacle through a plurality of receptacle outlets and toward outlets of a distributor. The receptacle is self-leveling with respect to the distributor such that liquid is divided by the receptacle outlets into predetermined proportions.

Another exemplary embodiment of the present invention provides a system configured to distribute liquid flow into predetermined proportions. The system includes at least one float coupled to a receptacle to level the receptacle by action of buoyancy of the float in contact with a portion of liquid collected in the interior of the distributor from one of several receptacle outlets. The buoyancy provided by the float maintains the receptacle horizontally level when the distributor is not level such that liquid is divided by the receptacle outlets into predetermined proportions.

A further exemplary embodiment of the present invention provides a system configured to distribute liquid flow into predetermined proportions. The system includes a support coupled to the distributor, wherein a receptacle is pivotally mounted on the support for movement with respect to the distributor. The receptacle is configured to remain horizontally level by the force of gravity when the distributor is not level such that liquid is divided by the receptacle outlets into predetermined proportions.

Another exemplary embodiment of the present invention provides a system configured to distribute liquid flow into predetermined proportions. The system includes a receptacle that is pivotally suspended with respect to a distributor. The receptacle is configured to remain horizontally level by the force of gravity when the distributor is not level such that liquid is divided by the receptacle outlets into predetermined proportions.

BRIEF DESCRIPTION OF THE DRAWINGS

The invention will be described with reference to the exemplary embodiments illustrated in the figures, of which.

DETAILED DESCRIPTION OF THE INVENTION

Exemplary features of embodiments of this invention will now be described with reference to the figures. It will be appreciated that the spirit and scope of the invention is not limited to the embodiments selected for illustration. Also, it should be noted that the drawings are not rendered to any particular scale or proportion. It is contemplated that any of the configurations and materials described hereafter can be modified within the scope of this invention.

Generally, with reference to FIGS. 1–13, the present invention provides a system, such as exemplary systems 20, 120, 320, 420, and 520, that is configured to distribute liquid flow "A" into predetermined proportions. The system includes a distributor, such as exemplary distributors 16, 116, 316, 416, and 516, defining a plurality of distributor outlets, such as exemplary outputs or outlets 18C, 118C, 318C, 418C, 518C, 18D, 118D, 318D, 418D, and 518D, configured to deliver liquid from the distributor. A receptacle, such as exemplary receptacles 14, 114, 214, 314, 414, and 514, is positioned to receive liquid. The receptacle defines a plurality of receptacle outlets, such as exemplary outlets 128, 228, 328, 428, and 528, oriented to deliver liquid portions "C," "D" toward the distributor outlets. The receptacle is pivotally mounted for movement with respect to the distributor, and is self-leveling such that liquid is divided by the receptacle outlets into predetermined proportions.

Another embodiment of the present invention provides a method for configuring a liquid distributor, such as distributors 16, 116, 316, 416, and 516, to distribute liquid flow "A" into predetermined proportions. The method includes positioning a receptacle, such as receptacles 14, 114, 214, 314, 414, and 514, to receive liquid and orienting receptacle outlets, such as outlets 128, 228, 328, 428, and 528, to deliver liquid toward distributor outlets, such as outlets 18C, 118C, 318C, 418C, 518C, 18D, 118D, 318D, 418D, 518D. The receptacle is pivotally mounted for movement and for self-leveling with respect to the liquid distributor such that liquid is divided by the receptacle outlets into the predetermined proportions.

A further embodiment of the present invention provides a method for distributing liquid flow "A" into predetermined proportions. The method includes supplying liquid to a receptacle, such as receptacles 14, 114, 214, 314, 414, and 514, and delivering liquid from the receptacle through a plurality of receptacle outlets, such as outlets 128, 228, 328, 428, and 528, and toward outlets, such as outlets 18C, 118C, 318C, 418C, 518C, 18D, 118D, 318D, 418D, and 518D, of a distributor, such as distributors 16, 116, 316, 416, and 516. The receptacle is self-leveling with respect to the distributor such that liquid is divided by the receptacle outlets into predetermined proportions.

Figure 1:
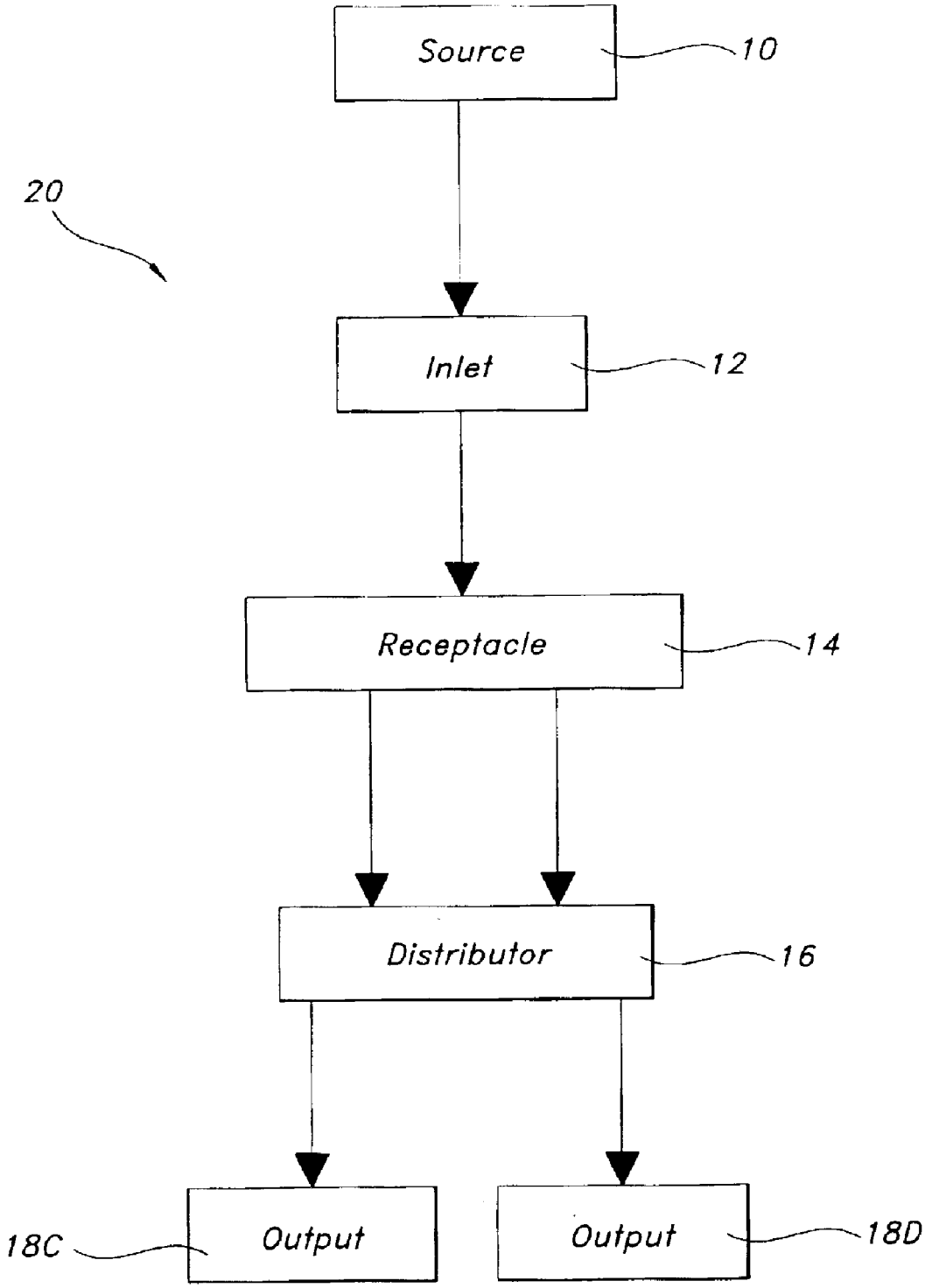
FIG. 1 is a block diagram of an exemplary embodiment of a system configured to distribute liquid flow into predetermined proportions in accordance with aspects of the present invention.

Referring specifically to the exemplary embodiment illustrated in FIG. 1, the present invention provides a system configured to distribute liquid flow into predetermined proportions. Liquid, typically wastewater and/or effluent in one application of the present invention, is discharged from a source 10, typically a wastewater storage system or septic tank, to an inlet 12 of a receptacle 14. The receptacle 14 is self-leveling with respect to a distributor 16. The self-leveling feature helps to ensure an even distribution of liquid from the distributor 16 to outputs 18C, 18D for distribution such as to an absorption field. As is made clear throughout this description, the present invention encompasses various embodiments of the receptacle 14 and the distributor 16 illustrated in FIG. 1.

Figure 2:
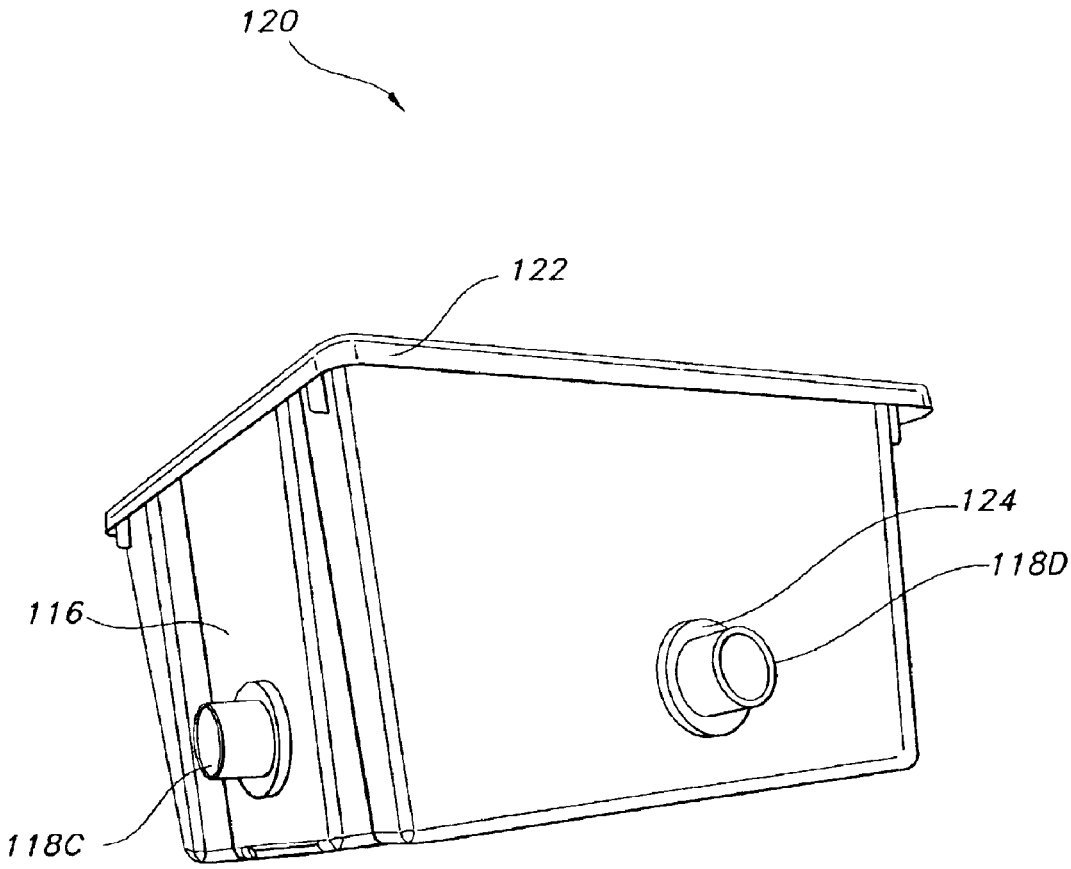
FIG. 2 is a perspective view of an exemplary embodiment of a distributor system in accordance with aspects of the present invention.

FIG. 2 illustrates an exemplary embodiment of a distributor generally designated as 116. The distributor 116 includes an interior (not shown) to receive liquid (not shown) through an inlet (not shown) that may be formed in a lid 122, and a plurality of distributor outlets 118C, 118D configured to deliver liquid from the interior of the distributor 116. Grommets 124 are utilized at the distributor outlets 118C, 118D to help ensure watertight seals.

FIG. 2 illustrates that the exemplary distributor 116 has a cubical shape, wherein the distributor outlets 118C, 118D are disposed substantially 90 degrees apart. However, the present invention is not limited to a cubical-shaped distributor 116. For example, distributor 116 may have a triangular horizontal cross-section, a circular horizontal cross-section, or any other shape that includes a desirable configuration of distributor outlets 118C, 118D, or the like for the distribution of liquid.

Exemplary distributor 116 is made from molded or otherwise formed plastic. However, any non-corrosive material, metal or plastic, capable of maintaining the structure of the distributor 116 is suitable.

FIG. 2 illustrates that the distributor outlets 118C, 118D, and the like are tubular-shaped with circular cross-sections. However, the present invention is not limited to circular cross-sectioned distributor outlets 118C, 118D. A variety of hollow shapes or openings may be utilized, so long as they accommodate fluid flow. The exemplary distributor outlets 118C, 118D may be made from polyvinyl chloride or any other non-corrosive material capable of accommodating fluid flow. Other materials can be substituted as well.

Figure 3:
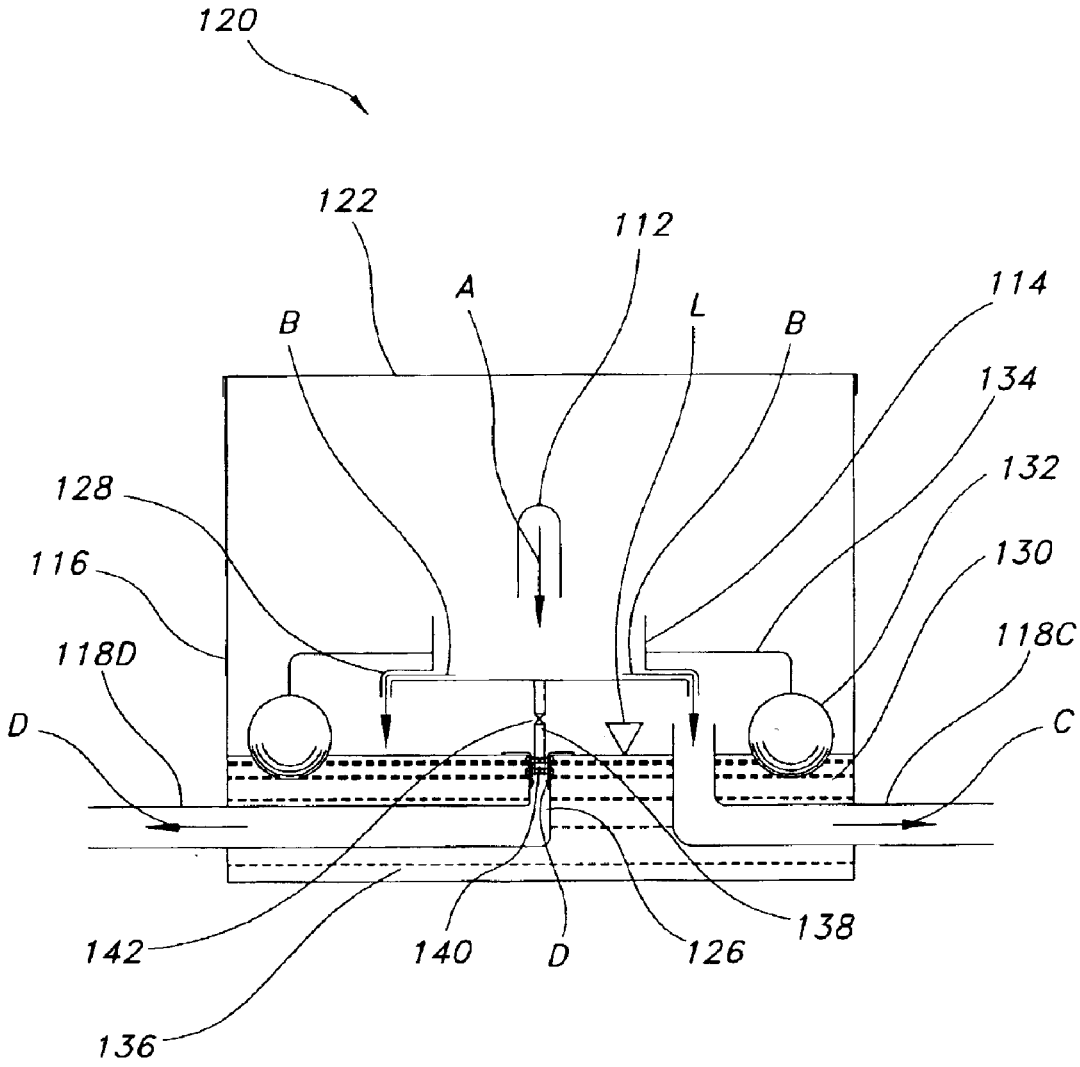
FIG. 3 is a schematic cross-sectional side view of the distributor system illustrated in FIG. 2, with side outlets in a level position utilizing floats in accordance with aspects of the present invention.

Referring next to FIG. 3, an exemplary embodiment of a receptacle, generally designated as 114, is illustrated. As illustrated in FIG. 3, a system 120 is configured to distribute liquid flow "A" into predetermined proportions "C" and "D." The system 120 includes a distributor 116 in a level position (as illustrated) defining a plurality of distributor outlets 118C, 118D configured to deliver liquid from the distributor 116. The receptacle 114 is positioned to receive liquid, the receptacle 114 defining a plurality of receptacle outlets 128 oriented to deliver liquid portions "B" toward the distributor outlets 118C, 118D. The receptacle 114 is pivotally mounted for movement with respect to the distributor 116, and is self-leveling such that liquid is divided by the receptacle outlets 128 into predetermined proportions.

As illustrated in FIG. 3, the distributor includes a lid 122 and an inlet pipe 112 positioned to deliver liquid to the receptacle 114. The distributor outlets 118C, 118D distribute liquid flow "C" and "D" from the distributor's interior 136. An overflow tube 126 is positioned in the center of the distributor's interior 136, and a bracket 140 secures a support or vertical restraint 138 to the overflow tube 126. The receptacle 114 is pivotally mounted to the distributor 116 by means of the vertical restraint 138 and a universal joint 142. The universal joint 142 permits the receptacle 114 to pivot without rotating about the axis of the vertical restraint 138, while the vertical restraint 138 prevents the receptacle 114 from moving vertically. At least one float 132 (two shown) is coupled to the receptacle 114 via a float connector 134.

FIG. 3 illustrates that the exemplary floats 132 have a spherical shape, wherein they are disposed substantially 180 degrees apart. However, the present invention is not limited to spherical-shaped floats 132. For example, float 132 may be cubical-shaped, triangular-shaped, or any other shape that provides the required buoyancy. Furthermore, the present invention is not limited to two floats 132 disposed substantially 180 degrees apart. For example, four floats disposed substantially 90 degrees apart may be utilized, as illustrated and described subsequently with reference to FIG. 5. Any other number and configuration of floats may be utilized, so long as the necessary buoyancy is achieved.

Exemplary float 132 is made from polystyrene foam. However, any material capable of providing the necessary buoyancy is suitable. Furthermore, the floats 132 may be made from a material that is inflated with air to provide the required buoyancy.

FIG. 3 illustrates that the float connectors 134 are straight members with a 90-degree elbow. However, the present invention is not limited to such a configuration. A variety of member shapes may be utilized, long as they rigidly secure the floats 132 to the receptacle 114. The exemplary float connectors 134 may be made from wood, plastic, metal, or any other material capable of providing the necessary rigidity.

In the illustrated embodiment, the receptacle outlets 128 are conduits or pipes. As will be described subsequently with reference to FIG. 7, another exemplary embodiment of the receptacle, generally designated as 214, includes outlets 228 that are formed as weirs or notches, as opposed to the conduits or pipes 128 of receptacle 114.

Figure 4:
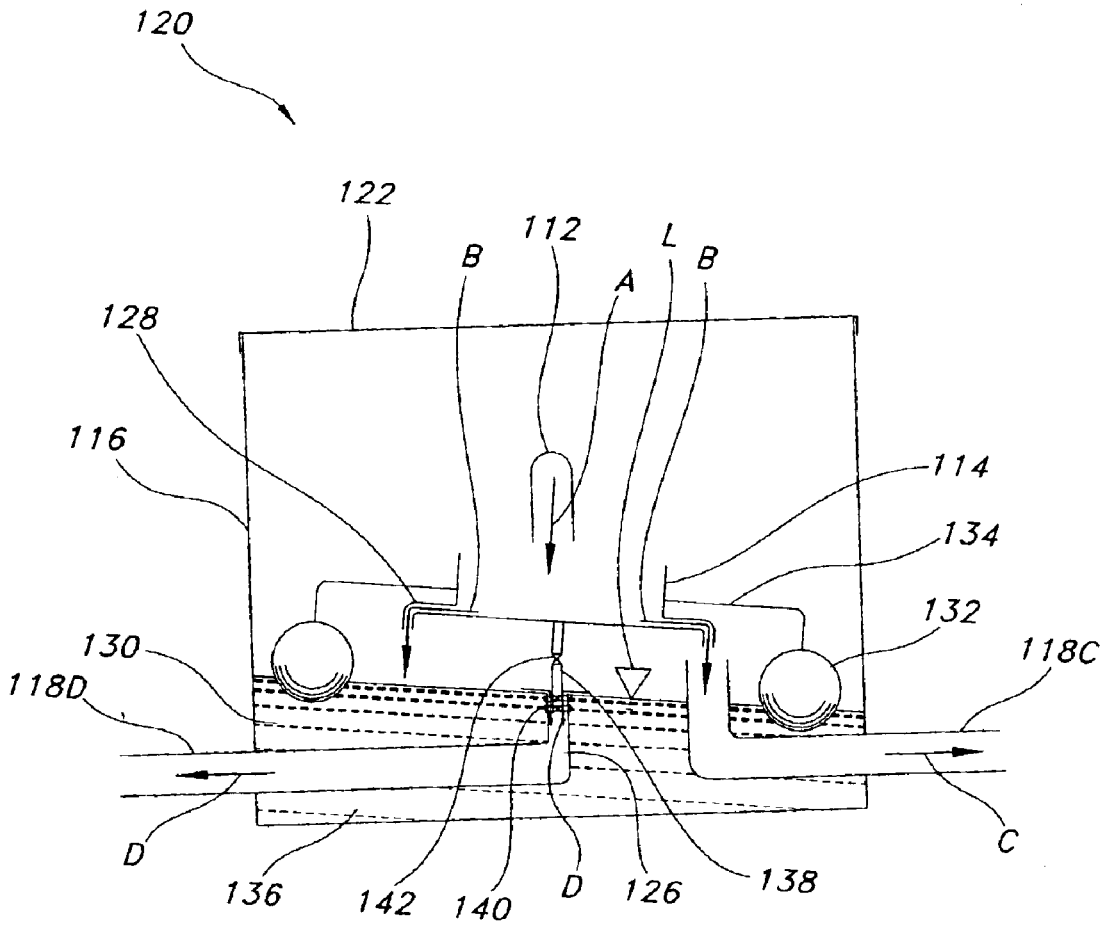
FIG. 4 is a schematic cross-sectional side view of the distributor system illustrated in FIG. 3, in a tilted position.

During operation of the distribution system embodiment illustrated in FIG. 3, liquid flow "A" is delivered from a source through the inlet pipe 112 to the receptacle 114. The liquid flow "B" is then delivered through the receptacle outlets 128. A portion of liquid flow "B" is delivered to distributor outlet 118C to be distributed as liquid flow "C," while another portion of liquid flow "B" collects in the distributor interior 136 as liquid 130. The liquid level "L" rises in the distributor interior 136, and the buoyancy of the floats 132 in contact with the liquid 130 ensures that the receptacle outlets 128 reside in a plane substantially parallel to the level "L" of liquid 130 collected in the distributor interior 136. In other words, the buoyancy of the floats 132, combined with the pivoting action of the universal joint 142, function to maintain the receptacle 114 (and thereby the receptacle outlets 128) horizontally level, even when the distributor 116 is not level, as illustrated in FIG. 4. In effect, the receptacle 114 is configured to remain horizontally level by the force of gravity when the distributor 116 is not level.

The liquid level "L" continues to rise in the distributor interior 136 until it reaches the top opening of the overflow tube 126, at which time the liquid 130 that enters the overflow tube 126 is distributed through distributor outlet 118D as liquid flow "D."

Because the receptacle 114 is maintained substantially horizontally level regardless of the angle at which the distributor 116 is positioned, the rates of flow "B" are substantially equal. In other words, the rate at which flow "B" collects in the distributor interior 136, thereby causing the level "L" of liquid 130 to rise and fluid flow "D" to be distributed through distributor outlet 118D, is the same as the rate at which flow "B" is delivered to distributor outlet 118C to be distributed as liquid flow "C." Consequently, separate, reasonably equal quantities of liquid 130 pass through the distributor outlets 118C, 118D for distribution in an absorption field.

Means for suppressing movement of liquid collected in the interior of the distributor as the distributor moves can be provided. More particularly, it may be necessary or desirable to incorporate a structure in the interior region of the distributor to prevent or reduce the movement, flow, or "sloshing" of liquid contained therein. For example, in some applications of this invention, the distributor may move to such an extent that its contents slosh from one side to another. For example, if mounted on a marine vessel such as a surface ship or a submarine, the distributor may move as the marine vessel moves, thereby causing the liquid in the distributor to slosh. Such sloshing could cause erratic movement of the receptacle, especially when floats are used to maintain the receptacle in a level orientation as in the distributor system embodiment illustrated in FIGS. 3–5.

By including a structure to suppress such movement of the contents of the distributor, this "sloshing" effect is minimized or eliminated. Suitable suppressing means can optionally include one or more of an orifice for limiting flow between or among portions of the interior of the distributor, a baffle positioned to at least partially separate interior portions of the distributor, a porous medium for modifying or impeding the flow of liquid within the distributors interior, or any other known structure for inhibiting liquid movement within a space. The bottom of the distributor 116 may optionally be made in a hemispherical shape to help minimize sloshing and wave action in the interior 136 of the distributor 116.

Figure 5:
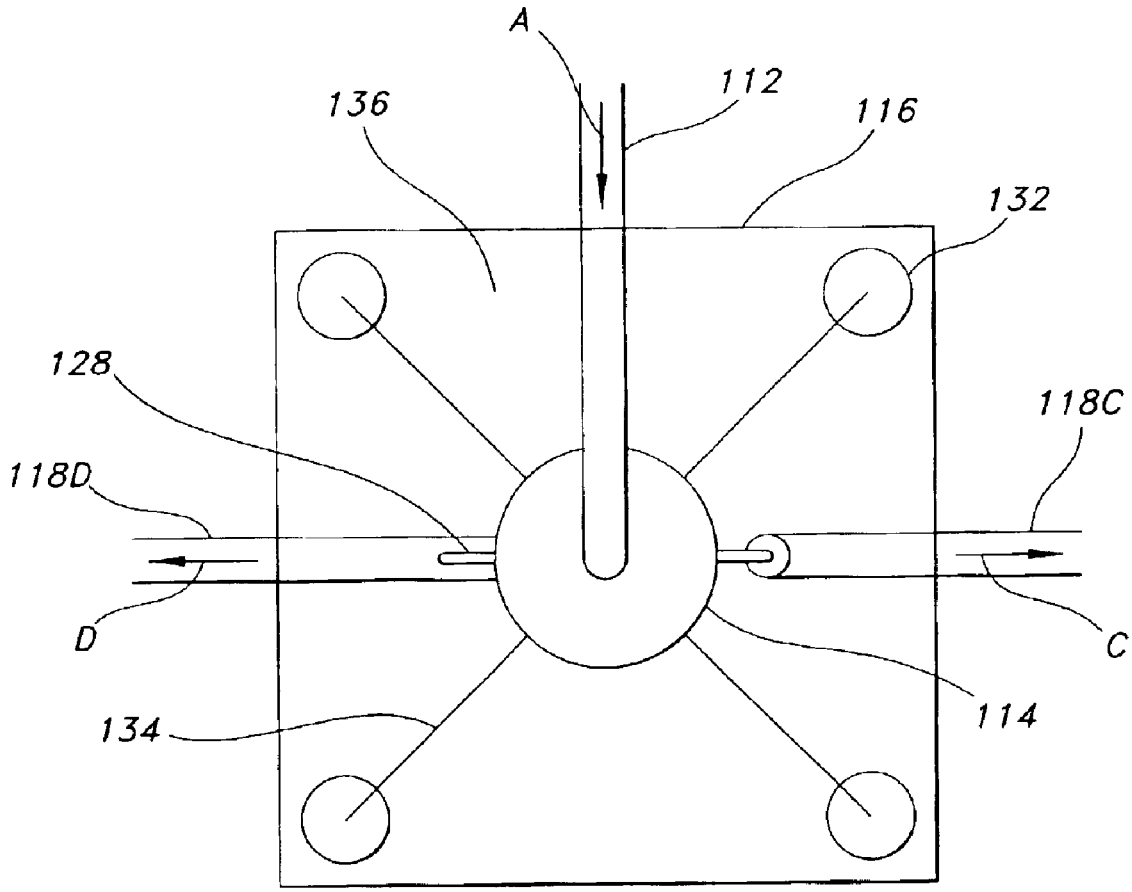
FIG. 5 is a plan view of the distributor system illustrated in FIG. 3.

FIG. 5 is a plan view of the embodiment of the distributor 116 represented in FIG. 3. FIG. 5 illustrates that four floats 132 can be attached to the receptacle 114 via float connectors 134. However, as described previously, the present invention is not limited to four floats 132, and may include any float configuration that provides the necessary buoyancy to keep the receptacle floating level in the liquid 130. A system utilizing a single float shaped for liquid contact or any other number of floats is also contemplated. Preferably, the float or floats are shaped and positioned with respect to the receptacle or to one another so as to maintain the receptacle in an orientation corresponding to the surface of the liquid. Most preferable, the float or floats define a plane substantially parallel to the plane of the receptacle outlets.

FIG. 5 also illustrates only one distributor outlet 118C that receives liquid flow "B" directly from a receptacle outlet 128 (the other distributor outlet 118D receives flow from liquid 130 contained in the interior 136 of the distributor 116). However, the present invention is not limited to only one such distributor outlet, and may include any number of receptacle outlets 128 with corresponding distributor outlets 118C for the even (or otherwise proportioned) distribution of liquid.

Figure 6:
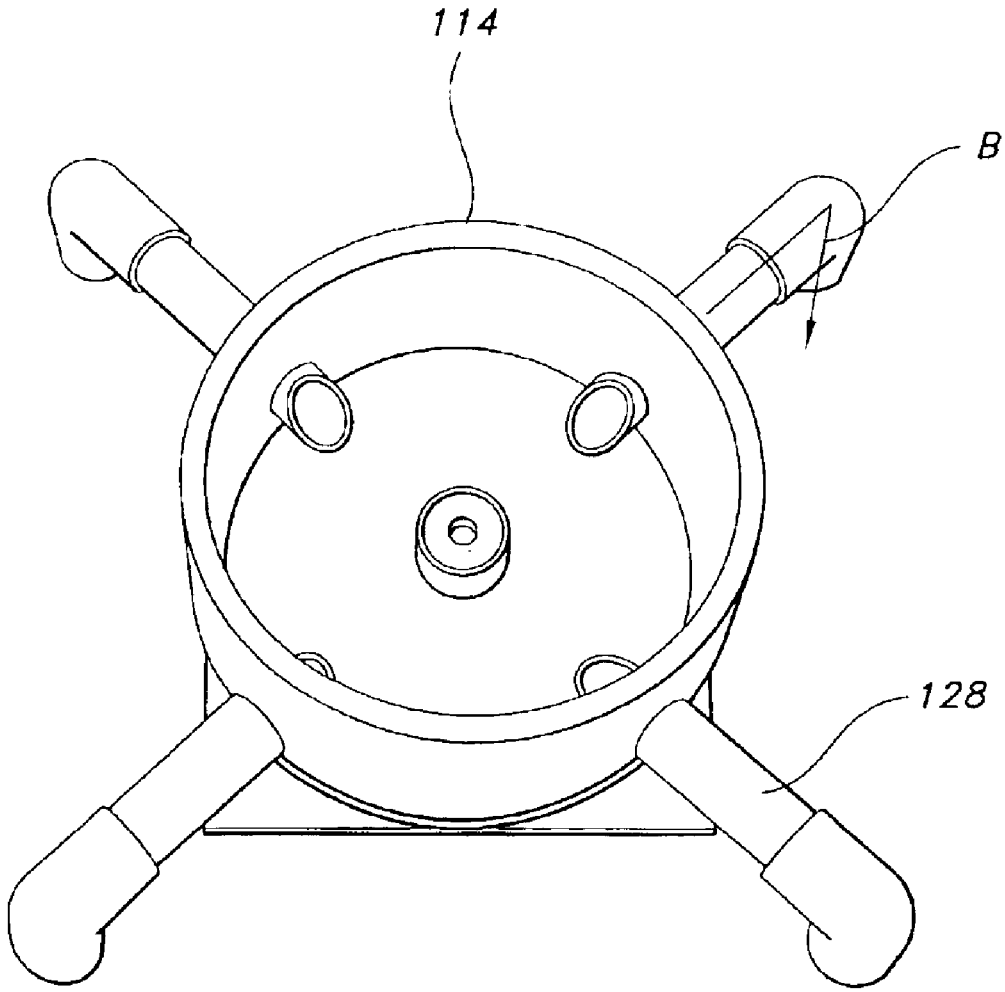
FIG. 6 is a perspective view of an exemplary embodiment of a receptacle configured for use with the distributor system illustrated in FIG. 3.

FIG. 6 is a perspective view of the receptacle 114 represented in FIGS. 3–5, but illustrating four receptacle outlets 128. The receptacle 114 includes three receptacle outlets 128 for delivering liquid directly to distributor outlets, and one receptacle outlet 128 for delivering liquid into the interior of the distributor for collection.

Though receptacle outlets 128 can be provided in any known form, the embodiment of receptacle 114 illustrated in FIG. 6 includes outlets in the form of conduits or passageways. More specifically, three of the conduits or passageways of the receptacle 114 are oriented in such a way that they deliver liquid flow "B" to distributor outlets "C," and one receptacle outlet 128 delivers liquid flow "B" for collection in the distributor interior 136 and resulting in eventual distribution of liquid flow "D" through distributor outlet 118D. As described previously, the present invention may include any number of receptacle outlets 128 with corresponding distributor outlets 118C for the distribution of liquid.

A preferred receptacle 114 is made from molded or otherwise formed plastic. However, any non-corrosive material, metal or plastic, capable of capturing liquid is suitable.

Figure 7:
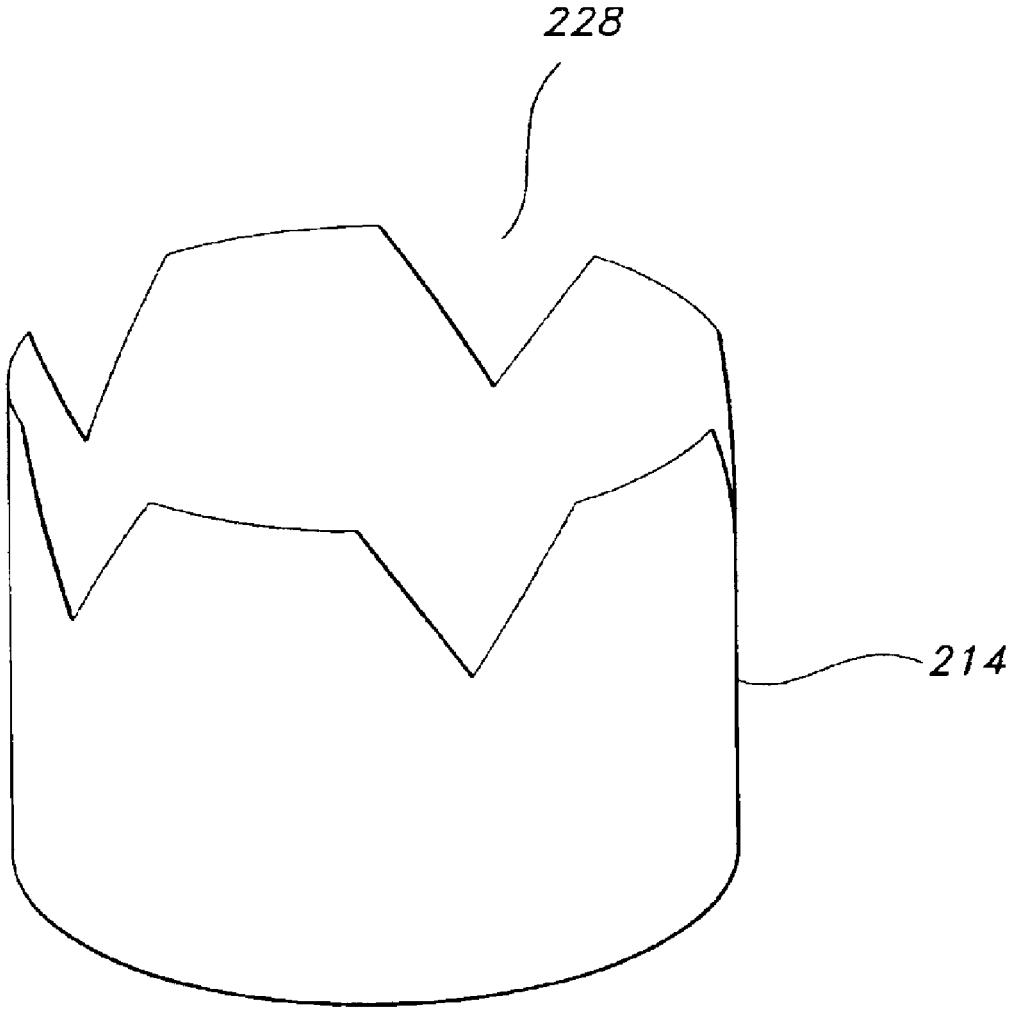
FIG. 7 is a perspective view of another exemplary embodiment of a receptacle in accordance with aspects of the present invention.

FIG. 7 is a perspective view of another exemplary embodiment of the receptacle, generally designated as 214. As illustrated, the receptacle outlets 228 are formed as weirs or notches, as opposed to the conduits or pipes of receptacle 114. The function and operation of receptacle 214 is virtually the same as that of receptacle 114, described previously with reference to FIGS. 3–6. The receptacle outlets 228 are shaped or otherwise configured to direct or concentrate flow from the receptacle 214. The embodiment of outlets 228 shown in FIG. 7 acts like a spout to direct flow from the receptacle 214. While weir and notch shapes are suitable to meet this purpose, it will be appreciated that any known shape and configuration can be used for outlets 228 to direct flow from the receptacle 214.

Figure 8:
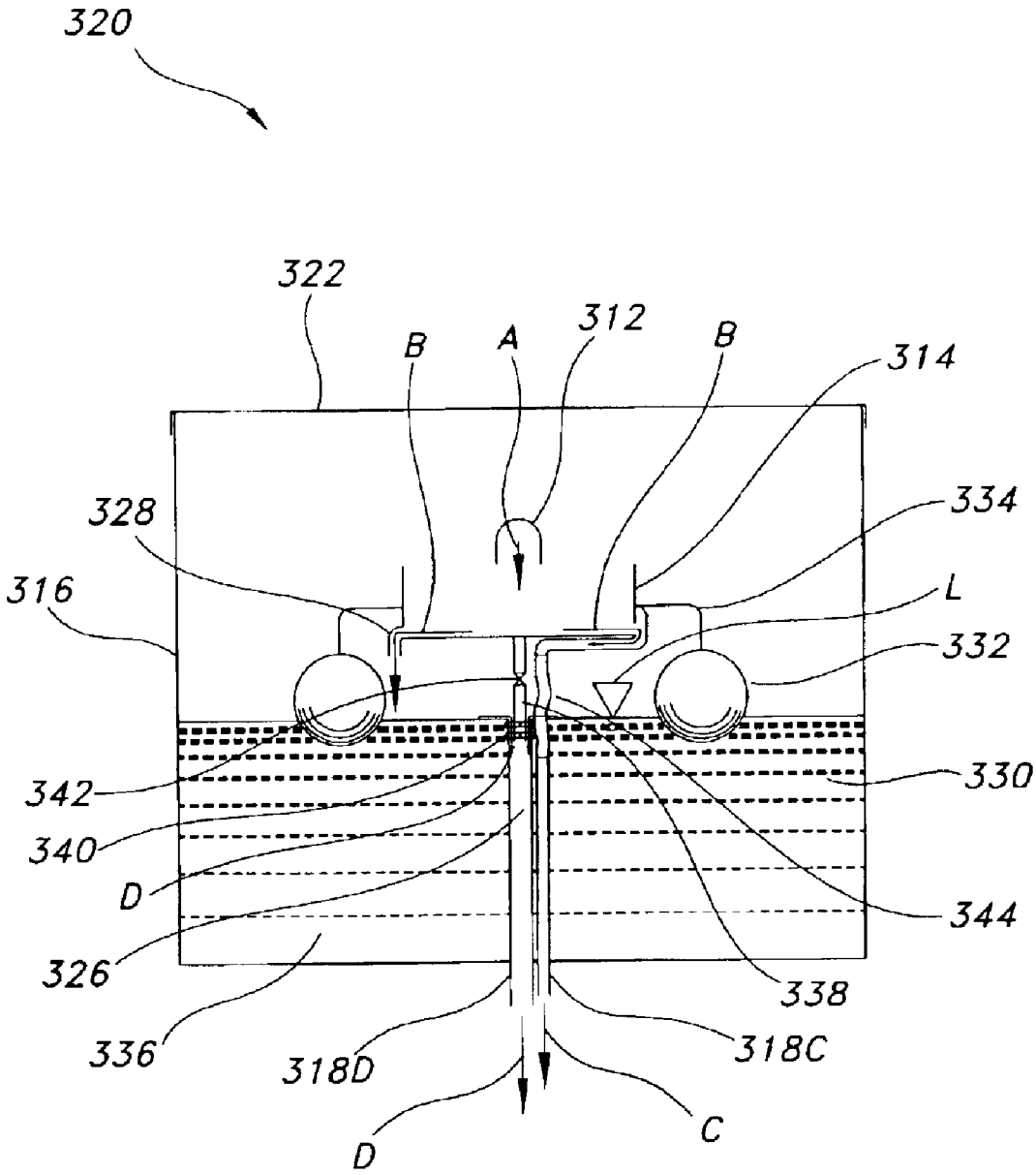
FIG. 8 is a schematic cross-sectional side view of another exemplary embodiment of a distributor system with bottom outlets in a level position utilizing floats in accordance with aspects of the present invention.
Figure 9:
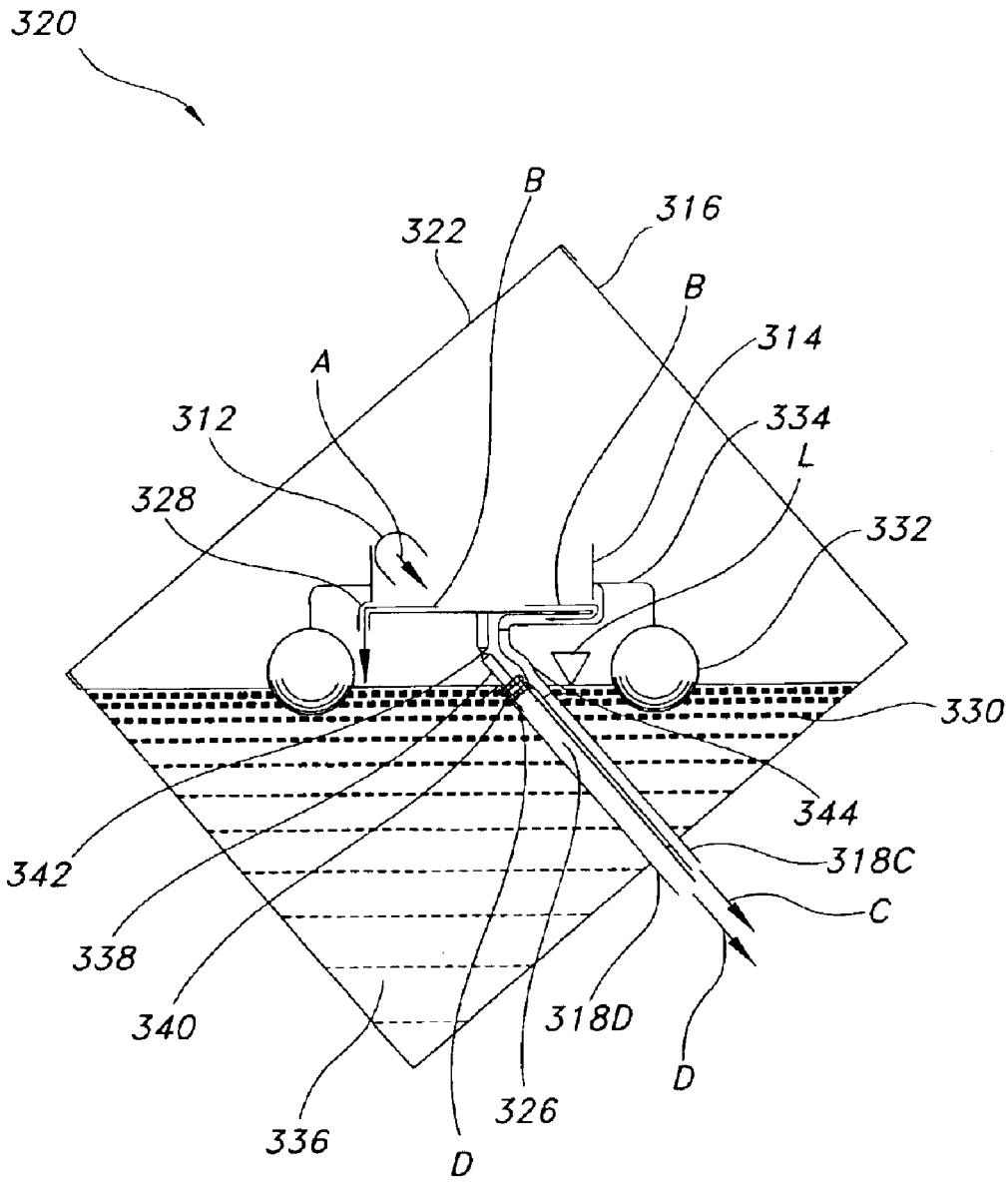
FIG. 9 is a schematic cross-sectional side view of the distributor system illustrated in FIG. 8, in a tilted position.

FIGS. 8 and 9 illustrate an embodiment of a liquid distribution system 320 adapted to accommodate circumstances in which the distributor 316 is tilted at an extreme angle. Like system 120, system 320 includes a distributor 316, distributor outlets 318C, 318D, a receptacle 314, a plurality of receptacle outlets 328, a lid 322, an inlet pipe 312, a distributor interior 336, an overflow tube 326, a bracket 340, a vertical restraint 338, a universal joint 342, at least one float 332, and a float connector 334.

To ensure that liquid flow "B" is delivered through the distributor outlet 318C as fluid flow "C," a conduit such as a flexible hose 344 connects the receptacle outlet 328 to the distributor outlet 318C. In this embodiment, both of the distributor outlets 318C and 318D are oriented downwardly and are positioned toward the center of the distributor 316. As is illustrated in FIG. 9, in which the distributor is tilted at a significant angle, the central and downward orientation of the outlets 318C and 318D help to ensure that liquid will be able to flow downwardly from the interior 336 of the distributor 316.

The function and operation of system 320 is virtually the same as that of system 120, described previously with reference to FIGS. 3–5. The system 320 is, however, better suited for applications in which the distributor 316 moves through a wider range of positions such as on board a marine vessel, in an airplane or other vehicle, or elsewhere.

Figure 10:
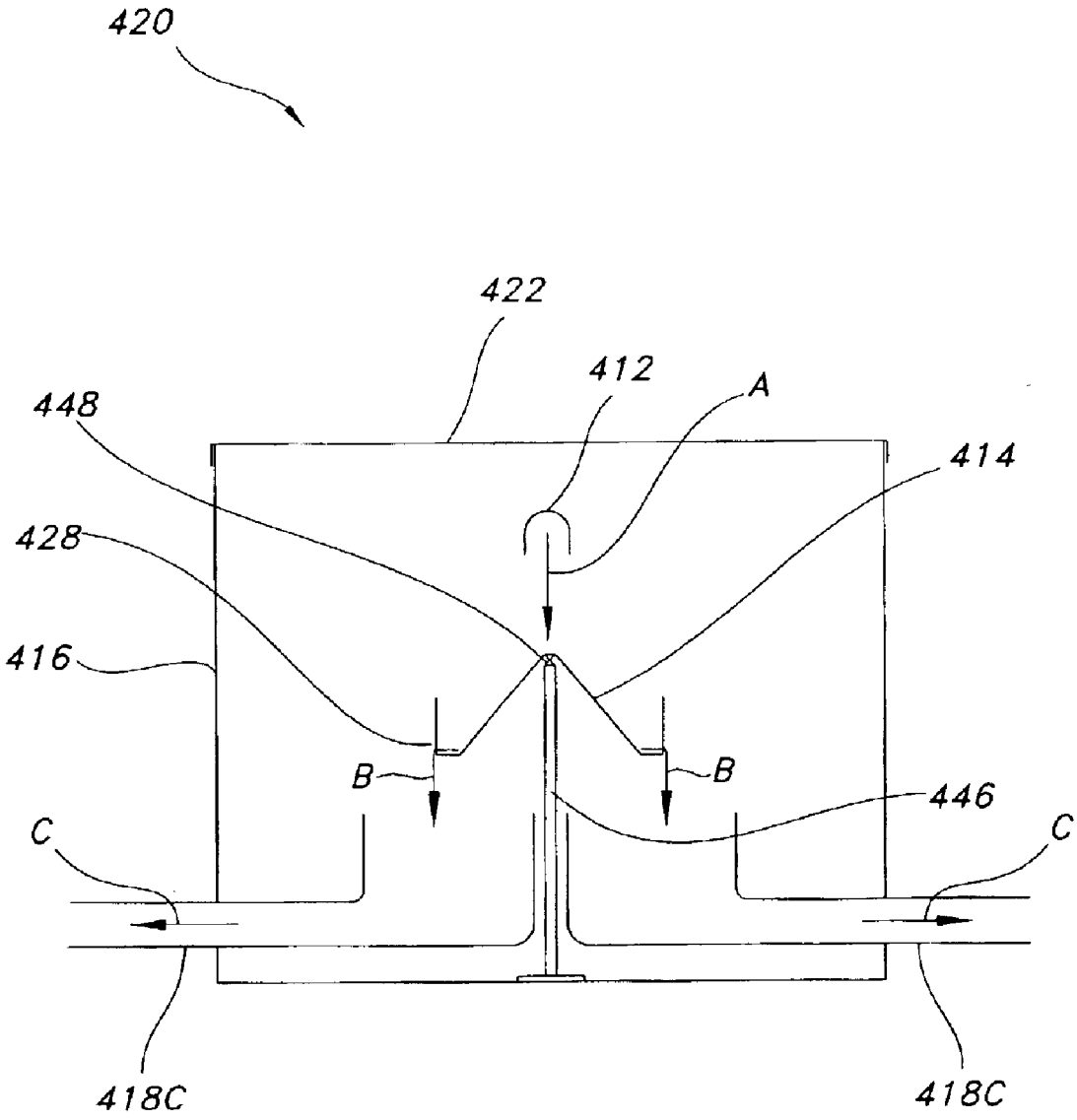
FIG. 10 is a schematic cross-sectional side view of yet another exemplary embodiment of a distributor system in a level position utilizing a support in accordance with aspects of the present invention.

Referring specifically to FIG. 10, yet another exemplary embodiment of a distribution system 420 is illustrated. Like system 120, system 420 includes a distributor 416, distributor outlets 418C, a receptacle 414, a plurality of receptacle outlets 428, a lid 422, an inlet pipe 412, a receptacle support 446, and a pivot joint 448.

The system includes another embodiment of a receptacle, generally designated as 414, which is configured to be supported with respect to the distributor 416 in such a way that the force of gravity helps to maintain it in a substantially level orientation. The function and operation of system 420 is virtually the same as that of system 120, described previously with reference to FIGS. 3–5, with some notable differences in configuration.

As represented in FIG. 10, receptacle 414 has a central portion that is upwardly convex. The receptacle 414 is pivotally mounted via a pivot joint 448 to a receptacle support 446. Unlike systems 120 and 320, system 420 does not need to include an overflow tube 126 because it does not rely upon the buoyancy provided by collected liquid or floats contacting collected liquid. Instead, liquid flow "B" is delivered directly from all receptacle outlets 428 to corresponding distributor outlets 418C, as liquid flow "C."

Figure 11:
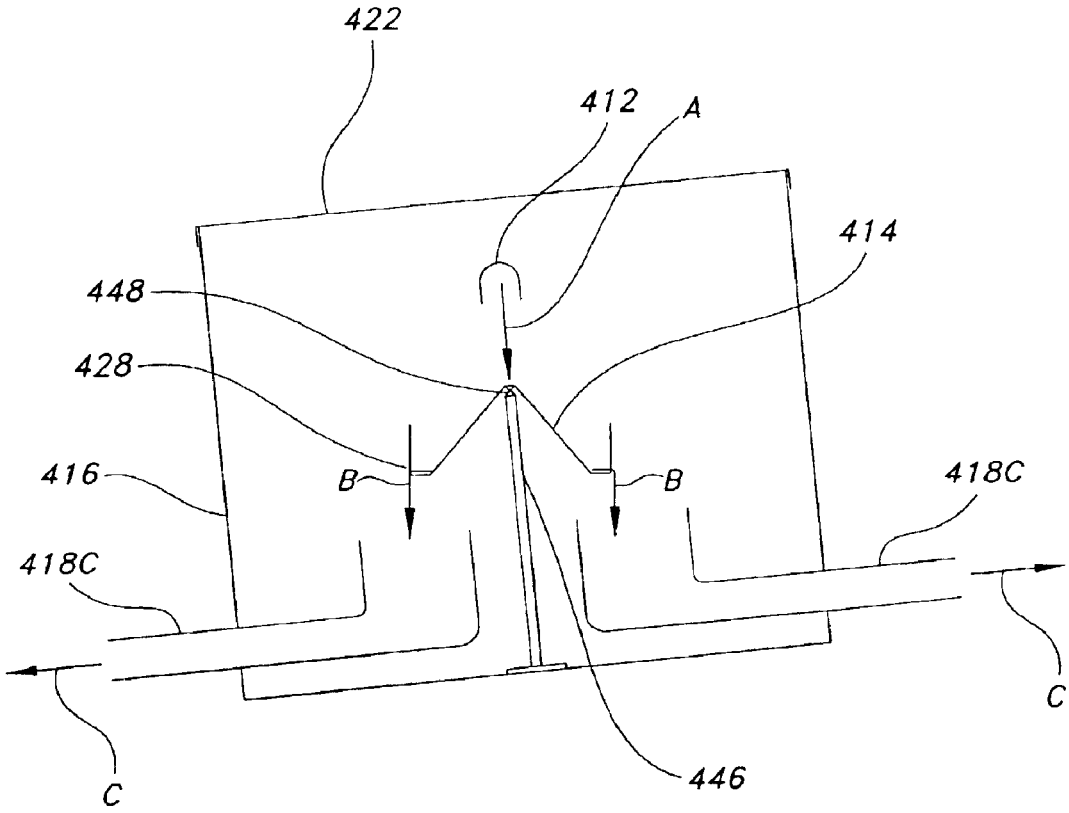
FIG. 11 is a schematic cross-sectional side view of the distributor system illustrated in FIG. 10, in a tilted position.

The pivot joint 448 functions to maintain the receptacle 414 (and thereby the receptacle outlets 428) horizontally level, even when the distributor 416 is not level, as illustrated in FIG. 11. As described previously with reference to system 120 of FIGS. 3–5, in effect the receptacle 414 is configured to remain horizontally level by the force of gravity when the distributor 416 is not level. Consequently, separate, reasonably equal quantities of liquid pass through the distributor outlets 418C for distribution in an absorption field, for example.

The pivot joint 448 permits only angular movement of the receptacle 414, enabling the receptacle 414 to remain horizontally level. The pivot joint 448 does not permit rotational movement, thereby ensuring proper alignment of the receptacle outlets 428 and the distributor outlets 418C. In other words, if the receptacle 414 were permitted to rotate, misalignment of the receptacle 414 with respect to the distributor outlets 418C may prevent the delivery of liquid flow "B" into the openings of distributor outlets 418C. The non-rotational feature of pivot joint 448 helps to ensure that the receptacle 414 remains properly aligned with respect to the distributor outlets 418C, thereby ensuring that the distributor outlets 418C will receive liquid flow "B."

Figure 12:
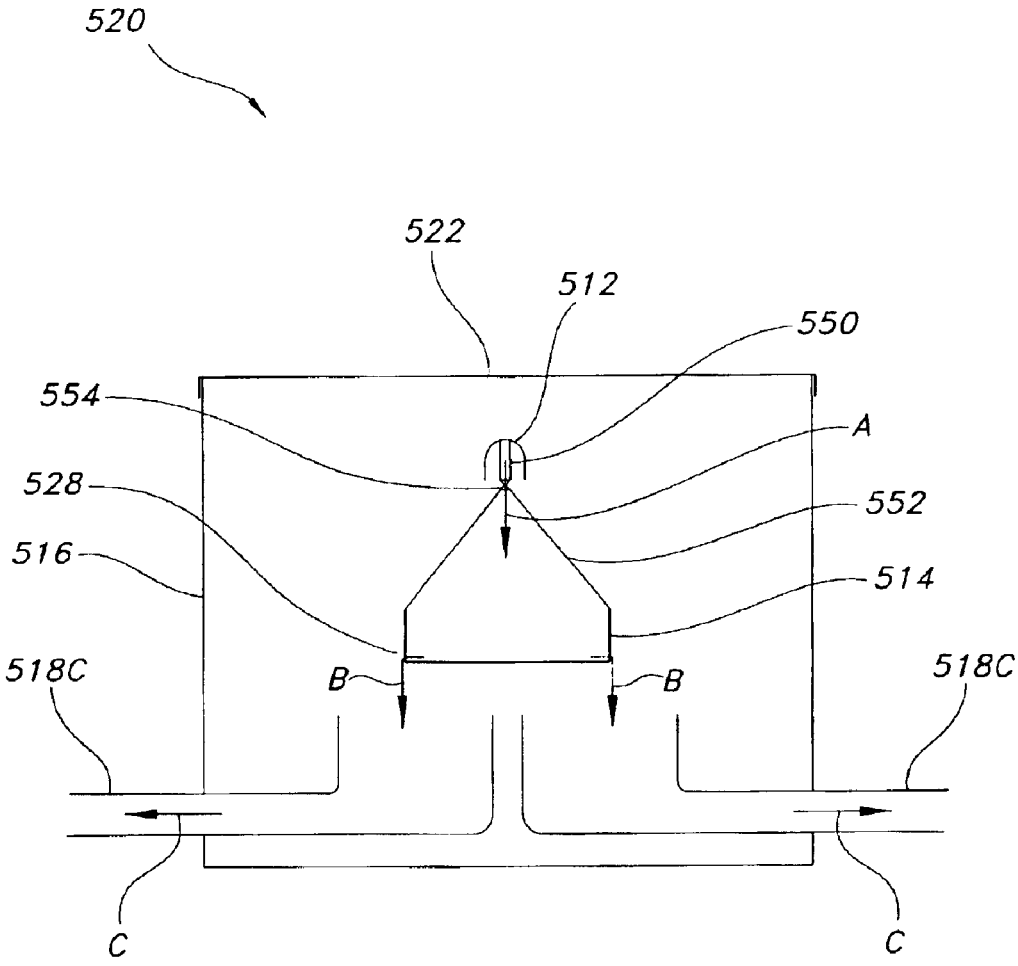
FIG. 12 is a schematic cross-sectional side view of still another exemplary embodiment of a distributor system in a level position utilizing a suspended member in accordance with aspects of the present invention.

Referring specifically to FIG. 12, a further embodiment of a distributor system 520 is illustrated. System 520 includes a receptacle, generally designated as 514, that is configured to be suspended with respect to the distributor 516 in such a way that it remains substantially level. Like system 120, system 520 includes a distributor 516, distributor outlets 518C, a receptacle 514, a plurality of receptacle outlets 528, a lid 522, an inlet pipe 512, a suspension member 550, a suspension pivot joint 554, and suspension wires 552.

The function and operation of system 520 is virtually the same as that of system 120, described previously with reference to FIGS. 3–5, with some notable differences in configuration. As represented in FIG. 12, receptacle 514 is pivotally suspended for movement with respect to the distributor 516. A suspension member 550 is positioned at or near the inlet pipe 512. The receptacle 514 is pivotally suspended from the suspension member 550 via a structure such as suspension wires 552 suspended from a suspension pivot joint 554. Unlike systems 120 and 320, but like system 420, system 520 does not include an overflow tube 126. Instead, similar to system 420 described previously with reference to FIGS. 10 and 11, liquid flow "B" is delivered directly from all receptacle outlets 528 to corresponding distributor outlets 518C, as liquid flow "C."

Figure 13:
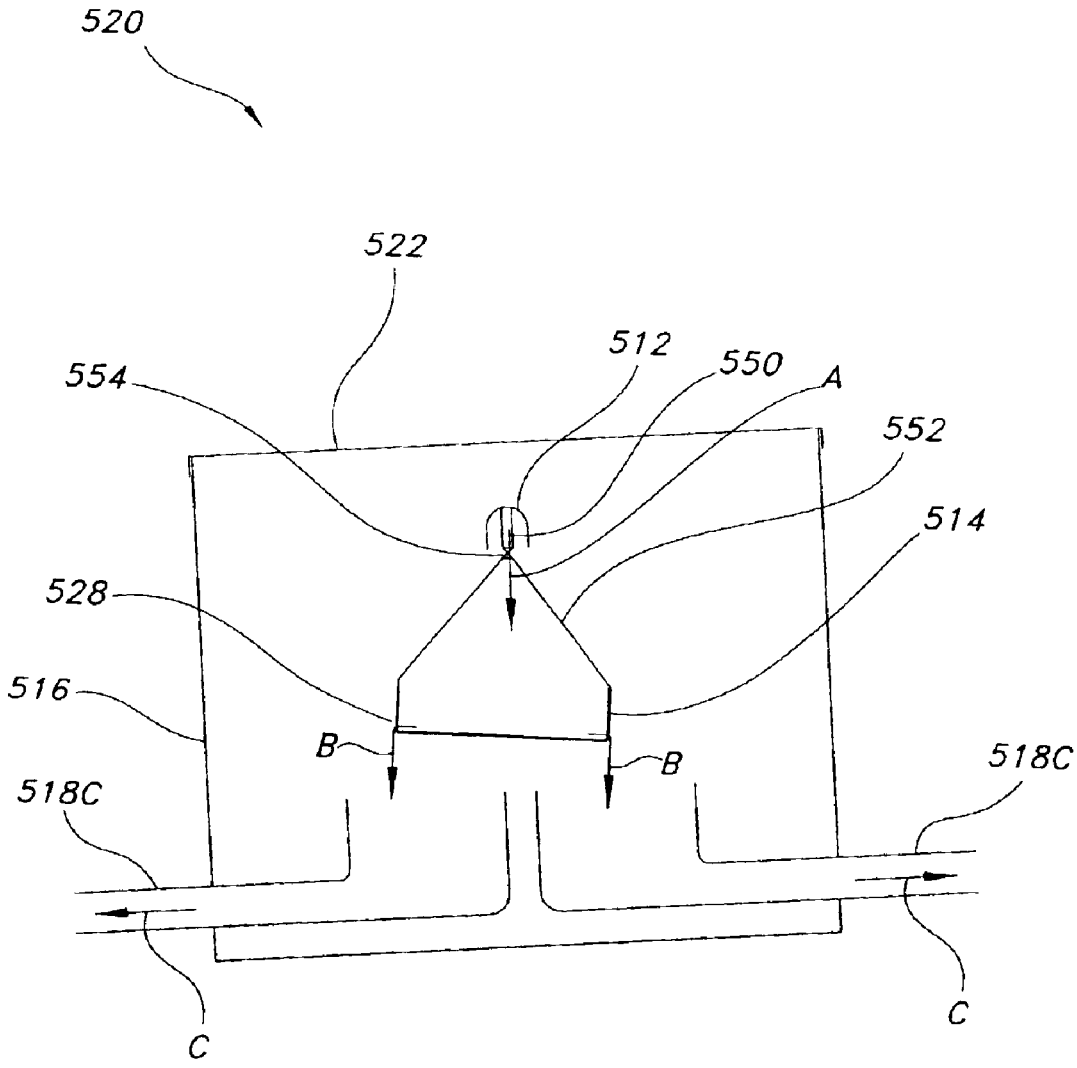
FIG. 13 a schematic cross-sectional side view of the distributor system illustrated in FIG. 12, in a tilted position.

The suspension pivot joint 554 functions to maintain the receptacle 514 (and thereby the receptacle outlets 528) horizontally level, even when the distributor 516 is not level, as illustrated in FIG. 13. As described previously with reference to system 120 of FIGS. 3–5, in effect the receptacle 514 is configured to remain horizontally level by the force of gravity when the distributor 516 is not level. Consequently, separate, reasonably equal quantities of liquid pass through the distributor outlets 518C for distribution in an absorption field.

Similar to the pivot joint 448 described previously with reference to FIGS. 10 and 11, the suspension pivot joint 554 permits only angular movement of the receptacle 514, enabling the receptacle 514 to remain horizontally level. The suspension pivot joint 554 does not permit rotational movement, thereby ensuring proper alignment of the receptacle outlets 528 and the distributor outlets 518C. In other words, if the receptacle 514 were permitted to rotate, misalignment of the receptacle 514 with respect to the distributor outlets 518C may prevent the delivery of liquid flow "B" into the openings of distributor outlets 518C. The non-rotational feature of suspension pivot joint 554 helps to ensure that the receptacle 514 remains is properly aligned with respect to the distributor outlets 518C, thereby ensuring that the distributor outlets 518C will receive liquid flow "B."

Figure 14:
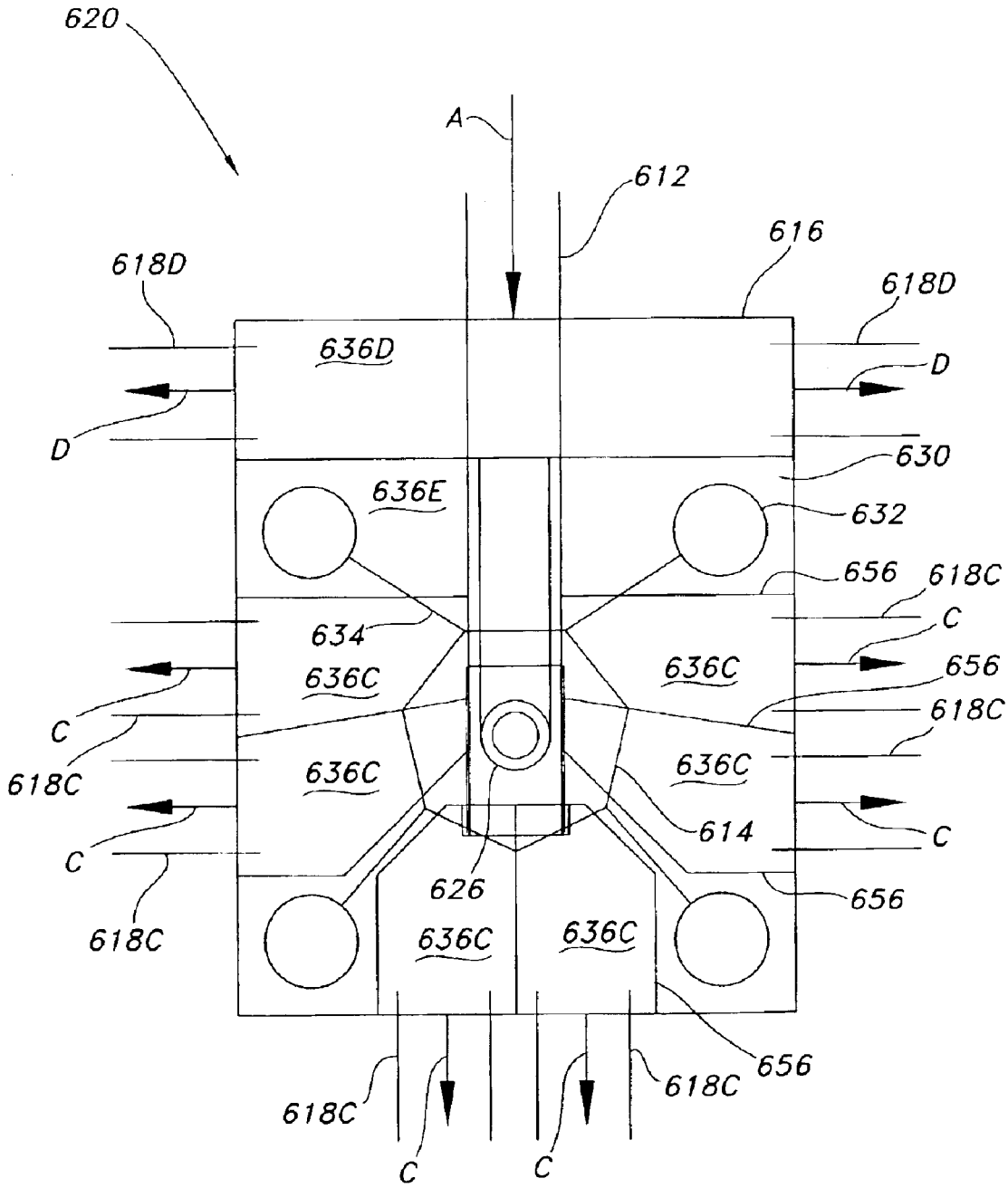
FIG. 14 is a plan view of yet another exemplary embodiment of a distributor system utilizing separation walls in accordance with aspects of the present invention.

Referring specifically to FIG. 14, a plan view of yet another exemplary embodiment of a distribution system 620 is illustrated. Like system 120, system 620 includes a distributor 616, distributor outlets 618C, 618D, a receptacle 614, a plurality of receptacle outlets 628 (not shown), floats 632, float connectors 634, a lid 622 (not shown), an inlet pipe 612, an overflow tube 626, a vertical restraint 638 (not shown), and a universal or similar joint 642 (not shown).

The function and operation of system 620 is virtually the same as that of system 120, described previously with reference to FIGS. 3–5, with some notable differences in the configuration of the distributor 616.

As represented in FIG. 14, the interior of the distributor 616 includes walls, dividers, compartments, or other means for defining sections or chambers within the distributor 616. For example, distributor 616 may include separation walls 656, creating a multi-chambered interior including chambers 636C, 636D, and 636E. The multi-chambered interior will be described subsequently with reference to FIG. 16.

Figure 15:
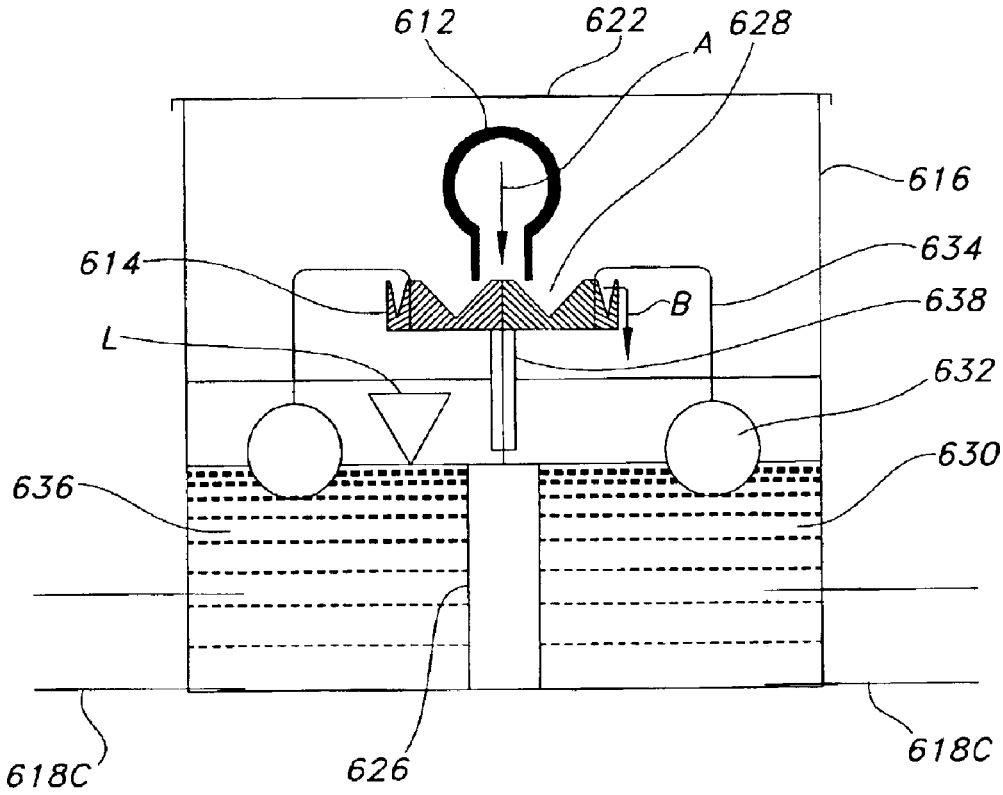
FIG. 15 is a schematic cross-sectional side view of the distributor system illustrated in FIG. 14, with side outlets in a level position, illustrating a notched receptacle and utilizing floats in accordance with aspects of the present invention.

FIG. 15 is a cross-sectional side view of the embodiment of the distribution system 620 represented in FIG. 14. The exemplary embodiment utilizes a receptacle 614 with receptacle outlets 628 that are formed as weirs is or notches, as described previously with reference to FIG. 7. The receptacle outlets 628 are shaped or otherwise configured to direct or concentrate flow from the receptacle 614. The receptacle outlets 628 shown in FIG. 15 act like spouts to direct flow from the receptacle 614 to compartments 636C and 636E within the interior 636 of the distributor 616.

Figure 16:
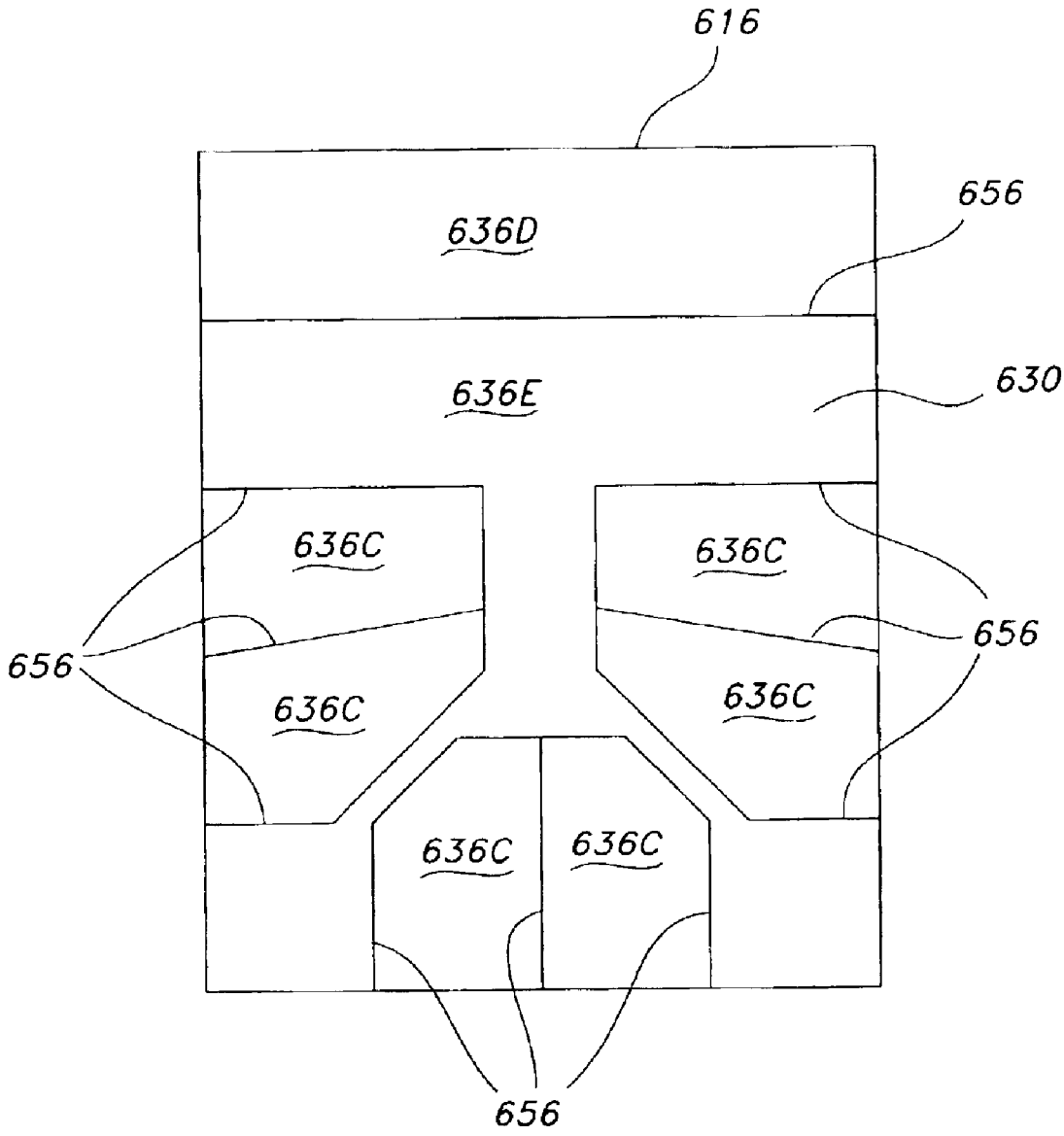
FIG. 16 is a plan view of the distributor component of the system illustrated in FIG. 14, with other system components removed to more clearly illustrate the configuration of the separation walls.

FIG. 16 is a plan view of the distributor component of the distribution system illustrated in FIG. 14, with other components removed to more clearly illustrate the configuration of the separation walls 656.

During operation of the distribution system embodiment illustrated in FIGS. 14–16, liquid flow "A" is delivered from a source through the inlet pipe 612 to the receptacle 614. Liquid flow "B" (represented in FIG. 15) is then delivered through the receptacle outlets 628. A portion of liquid flow "B" is delivered to compartments 636C to be distributed as liquid flows "C," while another portion of liquid flow "B" collects in compartment 636E as liquid 630. The liquid level "L" rises in the distributor interior 636, and as described previously with reference to FIGS. 3 and 4, the buoyancy of the floats 632 in contact with the liquid 630 in compartment 636E, combined with the pivoting action of the universal joint (not shown), function to maintain the receptacle 614 (and thereby the receptacle outlets 628) horizontally level, even when the distributor 616 is not level. Although not shown in FIG. 15, a pivot, universal, or other joint, such as the joint 142, 342, and 448 illustrated in FIGS. 3, 4, 8, 9, 10, and 11, can be utilized in the embodiment illustrated in FIGS. 14–16.

Unlike distribution systems 120, 320, 420, and 520 described previously, system 620 captures liquid flow "B" in compartments 636C rather than delivering liquid flow "B" into the openings of distributor outlets 118C, 318C, 418C, and 518C. Compartments 636C function like distributor outlets 118C, 318C, 418C, and 518C in that liquid is distributed through distributor outlets 618C as fluid flow "C."

The liquid level "L" continues to rise in compartment 636E until it reaches the top opening of the overflow tube 626 (illustrated in FIG. 15), at which time the liquid 630 that enters the overflow tube 626 is distributed to compartment 636D. One of the distributor outlets 618D can be closed at a given time, while the other one remains open. Liquid flows from compartment 636D through the open distributor outlet 618D as liquid flow "D."

As described previously with reference to FIGS. 3–5, because the receptacle 614 is maintained substantially horizontally level regardless of the angle at which the distributor 616 is positioned, separate, reasonably equal (or otherwise proportioned) quantities of liquid 630 pass through the distributor outlets 618C, 618D for distribution in an absorption field, for example.

FIGS. 14 and 16 illustrate that the configuration of the separation walls 656 results in seven distributor outlets 618C and 618D. However, the present invention is not limited to seven distributor outlets 618C and 618D. Depending upon the distribution needs of the particular application, the orientation of the separation walls 656 may be modified to result in various numbers and configurations of distributor outlets.

Exemplary separation walls 656 are made from molded or otherwise formed plastic. However, any non-corrosive material, metal or plastic, capable of maintaining the structure of the compartments 636C, 636D, and 636E is suitable.

The present invention provides an improvement over conventional methods of equalizing the flow of effluent out of a distribution box. The present invention reduces or eliminates the need for a user to monitor, inspect, and/or adjust the system to realize proportionate flow division such as for effluent loading of absorption fields. The present invention may also be implemented with minimal changes to conventional distribution boxes. In fact, the invention makes it possible to retrofit existing distributor boxes, whether installed or not, for future use.

Although the invention is illustrated and described herein with reference to specific, exemplary embodiments, the invention is not intended to be limited to the details shown. Rather, various modifications may be made in the details within the scope and range of equivalents of the claims and without departing from the invention. For example, the present invention is not limited to distributing reasonably equal portions of liquid. Through modification of the size, shape, and orientation of the receptacle outlets and the distribution outlets, varying amounts of liquid may be distributed as desired. For instance, marine vessel applications may require predetermined portions of fluid to be distributed to one or more holding tanks. Also, in the context of leach fields, one leach line may be longer than another leach line and be able to accommodate more flow.

The present invention is not limited to use in wastewater and sewage disposal systems dispersing wastewater and/or effluent. The present invention may accommodate any flowing liquid and may support various applications. For example, the present invention may support the petroleum industry by distributing oil or fuel in predetermined proportions. Furthermore, the present invention may support the agricultural industry by distributing predetermined portions of water to crops. Similarly, the present invention may distribute potable water in support of unique commercial or residential development needs. The shapes, sizes, and materials selected for the various system components may vary depending upon the system application.

While multiple embodiments and variations of the invention have been shown and described herein, it will be understood that such embodiments are provided by way of example only. Numerous additional variations, changes and substitutions will occur to those skilled in the art without departing from the spirit of the invention. Accordingly, it is intended that the appended claims cover all such variations as fall within the spirit and scope of the invention.

What is claimed:

1. A method for distributing liquid flow into predetermined proportions, said method comprising the steps of:

supplying liquid to a receptacle;

delivering liquid from the receptacle through a plurality of receptacle outlets and toward outlets of a distributor;

collecting a liquid portion from at least one of the receptacle outlets in an interior of the distributor; and self-leveling the receptacle with respect to the distributor such that liquid is divided by the receptacle outlets into predetermined proportions.

2. The method recited in claim 1 further comprising the step of collecting liquid in an interior of the distributor.

3. The method recited in claim 2, wherein said self-leveling step further comprises maintaining the receptacle outlets in a plane substantially parallel to the level of liquid present in the interior of the distributor.

4. The method recited in claim 2, wherein said self-leveling step comprises floating the receptacle on liquid in the distributor, thereby maintaining the receptacle horizontally level when the distributor is not level.

5. The method recited in claim 1, wherein said self-leveling step comprises balancing the receptacle on a support coupled to the distributor, thereby maintaining the receptacle level when the distributor is not level.

6. The method recited in claim 1, wherein said self-leveling step comprises suspending the receptacle with respect to the distributor, thereby maintaining the receptacle level when the distributor is not level.

7. A method for configuring a liquid distributor to distribute liquid flow into predetermined proportions, said method comprising the steps of:

positioning a receptacle to receive liquid;

orienting outlets of the receptacle to deliver liquid toward outlets of the liquid distributor with at least one outlet being oriented to deliver liquid to an interior of the liquid distributor; and mounting the receptacle for movement and self-leveling with respect to the liquid distributor such that liquid is divided by the receptacle outlets into the predetermined proportions.

8. The method recited in claim 7, wherein a portion of liquid collects in the interior of the liquid distributor, said method further comprising the step of positioning one of the distributor outlets to receive overflow from the interior of the distributor.

9. The method recited in claim 8, wherein said pivotally mounting step further comprises coupling at least one float to the receptacle to level the receptacle by action of buoyancy of the float in contact with liquid in the interior of the distributor.

10. The method recited in claim 8, further comprising the step of configuring the distributor to suppress movement of liquid in the interior of the distributor.

11. The method recited in claim 10, said configuring step comprising the installation of one or more of an orifice, a baffle, or a porous medium to suppress the movement of the liquid in the interior of the distributor.

12. The method recited in claim 7, said pivotally mounting step comprising coupling the receptacle to a support such that the force of gravity maintains the receptacle horizontally level when the distributor is not level.

13. The method recited in claim 7, said pivotally mounting step comprising suspending the receptacle with respect to the distributor such that the force of gravity maintains the receptacle horizontally level when the distributor is not level.

14. A system configured to distribute liquid flow into predetermined proportions, said system comprising:

a distributor defining a plurality of distributor outlets configured to deliver liquid from said distributor; and a receptacle positioned to receive liquid, said receptacle defining a plurality of receptacle outlets oriented to deliver liquid portions toward said distributor outlets, said receptacle being mounted from below for movement with respect to said distributor and being self-leveling such that liquid is divided by said receptacle outlets into predetermined proportions.

15. The system recited in claim 14, wherein each said receptacle outlet comprises an orifice, passageway, weir, notch, or conduit.

16. The system recited in claim 14, wherein a liquid portion from one of said receptacle outlets collects in an interior of said distributor.

17. The system recited in claim 16, wherein said receptacle outlets reside in a plane substantially parallel to the level of liquid collected in said interior of said distributor.

18. The system recited in claim 16 further comprising at least one float coupled to said receptacle to level said receptacle by action of buoyancy of said float in contact with liquid collected in said interior of said distributor.

19. The system recited in claim 18, wherein said buoyancy provided by said float maintains said receptacle horizontally level when said distributor is not level.

20. The system recited in claim 16, further comprising means for suppressing movement of liquid collected in said interior of said distributor as said distributor moves.

21. The system recited in claim 20, wherein said suppressing means comprises one or more of an orifice, a baffle, or a porous medium.

22. The system recited in claim 14 further comprising a support coupled to said distributor, said receptacle being pivotally mounted to said support for movement with respect to said distributor.

23. The system recited in claim 22, said receptacle being configured to remain horizontally level by the force of gravity when said distributor is not level.

24. The system recited in claim 23, said receptacle having a central portion that is upwardly convex.

25. The system recited in claim 14, wherein said receptacle is pivotally suspended for movement with respect to said distributor.

26. The system recited in claim 25, said receptacle being configured to remain horizontally level by the force of gravity when said distributor is not level.

27. The system recited in claim 14, said distributor comprising means for defining chambers configured to receive liquid from said receptacle.

28. The system recited in claim 27, said defining means comprising one or more of a wall, a divider, and a compartment.

29. A system configured to distribute liquid flow into predetermined proportions, said system comprising:

a distributor defining a plurality of distributor outlets configured to deliver liquid from said distributor;

a receptacle positioned to receive liquid, said receptacle defining a plurality of receptacle outlets oriented to deliver liquid portions toward said distributor outlets, and said receptacle being mounted for movement with respect to said distributor, wherein a liquid portion from one of said receptacle outlets collects in an interior of said distributor; and means for self-leveling said receptacle such that liquid is divided by said receptacle outlets into predetermined proportions.

30. The system recited in claim 29, said self-leveling means being selected from the group consisting of a float, a support, and a suspension member.

31. The system recited in claim 1, said distributor comprising means for defining chambers configured to receive liquid from said receptacle.

32. The system recited in claim 31, said defining means comprising one or more of a wall, a divider, and a compartment.

33. A system configured to distribute liquid flow into predetermined proportions, said system comprising:

a distributor defining an interior to receive liquid and a plurality of distributor outlets configured to deliver liquid from said interior;

a receptacle positioned within said distributor, said receptacle defining a plurality of receptacle outlets oriented to deliver liquid portions toward said distributor outlets, wherein a liquid portion from one of said receptacle outlets collects in said interior of said distributor; and at least one float coupled to said receptacle to level said receptacle by action of buoyancy of said float in contact with liquid collected in said interior of said distributor, wherein said buoyancy provided by said float maintains said receptacle horizontally level when said distributor is not level such that liquid is divided by said receptacle outlets into predetermined proportions.

34. The system recited in claim 33, wherein one of said distributor outlets is positioned to control the level of liquid collected in said interior of said distributor.

35. A system configured to distribute liquid flow into predetermined proportions, said system comprising:

a distributor defining a plurality of distributor outlets configured to deliver liquid from said distributor;

a receptacle pivotally mounted for movement with respect to said distributor, said receptacle defining a plurality of receptacle outlets oriented to deliver liquid portions toward said distributor outlets; and a support coupled to said distributor, said receptacle being pivotally mounted on said support for movement with respect to said distributor, said receptacle being configured to remain horizontally level by the force of gravity when said distributor is not level such that liquid is divided by said receptacle outlets into predetermined proportions.

36. A system configured to distribute liquid flow into predetermined proportions, said system comprising:

a distributor defining a plurality of distributor outlets configured to deliver liquid from said distributor;

a receptacle pivotally mounted for movement with respect to said distributor, said receptacle defining a plurality of receptacle outlets oriented to deliver liquid portions toward said distributor outlets; and said receptacle being pivotally suspended with respect to said distributor, and said receptacle being configured to remain horizontally level by the force of gravity when said distributor is not level such that liquid is divided by said receptacle outlets into predetermined proportions.

* * * * *